US006749480B1

(12) United States Patent
Hunts

(10) Patent No.: US 6,749,480 B1
(45) Date of Patent: Jun. 15, 2004

(54) DEVICE FOR CONNECTING PLURAL MULTI-SHAPED BODIES UTILIZING MAGNETS

(75) Inventor: Larry Dean Hunts, 451 Montclair Way, Eagle Point, OR (US) 97524

(73) Assignee: Larry Dean Hunts, White City, OR (US)

( * ) Notice: Subject to any disclaimer, the term of this patent is extended or adjusted under 35 U.S.C. 154(b) by 0 days.

(21) Appl. No.: 10/306,136

(22) Filed: Nov. 27, 2002

(51) Int. Cl.[7] ..... A63H 33/04
(52) U.S. Cl. ..... 446/92; 446/85
(58) Field of Search ..... 446/92, 85, 129; 273/156

(56) References Cited

U.S. PATENT DOCUMENTS

| | | | | | |
|---|---|---|---|---|---|
| 2,795,893 | A | * | 6/1957 | Vayo | 446/92 |
| 2,939,243 | A | * | 6/1960 | Duggar | 446/92 |
| 3,184,882 | A | * | 5/1965 | Vega | 446/92 |
| 3,254,440 | A | * | 6/1966 | Duggar | 446/92 |
| 4,238,905 | A | * | 12/1980 | MacGraw, II | 446/92 |
| 4,334,871 | A | * | 6/1982 | Roane | 446/92 |
| 4,401,960 | A | * | 8/1983 | Uchikune et al. | 335/285 |
| 5,009,625 | A | * | 4/1991 | Longuet-Higgins | 446/92 |
| 5,409,236 | A | * | 4/1995 | Therrien | 446/92 |
| 5,411,262 | A | * | 5/1995 | Smith | 446/92 |
| 5,746,638 | A | * | 5/1998 | Shiraishi | 446/92 |
| 6,241,249 | B1 | * | 6/2001 | Wang | 273/156 |

FOREIGN PATENT DOCUMENTS

| | | | | |
|---|---|---|---|---|
| EP | 51576 A2 | * | 5/1982 | A63H/33/04 |

* cited by examiner

*Primary Examiner*—Derris H. Banks
*Assistant Examiner*—Urszula M Cegielnik

(57) ABSTRACT

The devise described herein relates to connecting plural multi-shaped non metallic bodies utilizing disc shaped permanent magnets. The invention consists of disc magnets with axial orientation. The disc magnets are adhered within the center of a plastic bearing. The shape of the plastic bearing consists of a spherical segment relative to the height of the disc magnet creating a pivot point in the center of the disc magnet. Magnet and bearing combinations are placed into the spherical segment cavities reset into the plural bodies. When plural bodies containing the magnet bearing combination are placed close enough to over lap the flux field of each magnet reaction will be instantaneous rotation of the opposing magnets to there position of attraction and subsequently connecting the bodies together.

2 Claims, 5 Drawing Sheets

2
3
2
3
4
S
N
2
1a
1
1a
2
4
S
N
3
2
2a

DEVICE FOR CONNECTING PLURAL MULTI-SHAPED BODIES UTILIZING MAGNETS

BACKGROUND OF INVENTION

The present invention relates to connecting plural multi-shaped bodies utilizing permanent magnets contained within there bodies. More specifically the present invention devise achieves the connection of plural multi-shaped plastic bodies with magnets to each other with no regard to the polarity of opposing plural magnets.

Plastic bodies with magnets contained within there bodies are not new. U.S. Pat. No. 5,746,638 issued to Shiraishi describes one such design using magnets for connecting bodies, however the design has several disadvantages. First, the wall surface between attached magnets reduces the strength of the connection. Secondly the surface used in Shiraishi's design for the magnet to rotate on produces excessive resistance for instantaneous rotation of opposing magnets.

U.S. Pat. No. 5,347,253 issued to Ogikubo describes another design for attracting plural bodies with similar disadvantages. The necessity to incorporate a wall surface between opposing magnets lowering the strength of the connection between plural bodies utilizing magnets. The next disadvantage of Ogikubo's design is the shape of the magnet, which is a complete sphere. When plural sphere shaped magnets are connected, the point of contact between the surfaces of the magnets is small fraction of the magnet surfaces, lowering the strength of the connection between plural bodies utilizing magnets.

SUMMARY OF INVENTION

This invention provides a devise to align the poles of permanent magnets contained within plural bodies to there position of attraction securing the connection of plural bodies. This is accomplished thru the use of the magnet bearing combination that is seated within bearing cavities in the bodies and retained in this position using the bearing cap. This invention allows plural bodies with magnets reset into the surfaces of the bodies to be connected in any positional relation with no regard to the polarity of the magnets.

It is the object of the present invention to solve previous disadvantages thru the present invention devise which utilizes the maximum strength of permanent magnets and creates the least resistance from opposing magnets during there rotation to there attraction position for connecting plural bodies. It is yet another object of the present invention to utilize the present devise in all plural bodies having mutual attraction requirements such as toy blocks, puzzle pieces and construction sets but not limited to these few applications.

DETAILED DESCRIPTION OF THE INVENTION

Figure 1:
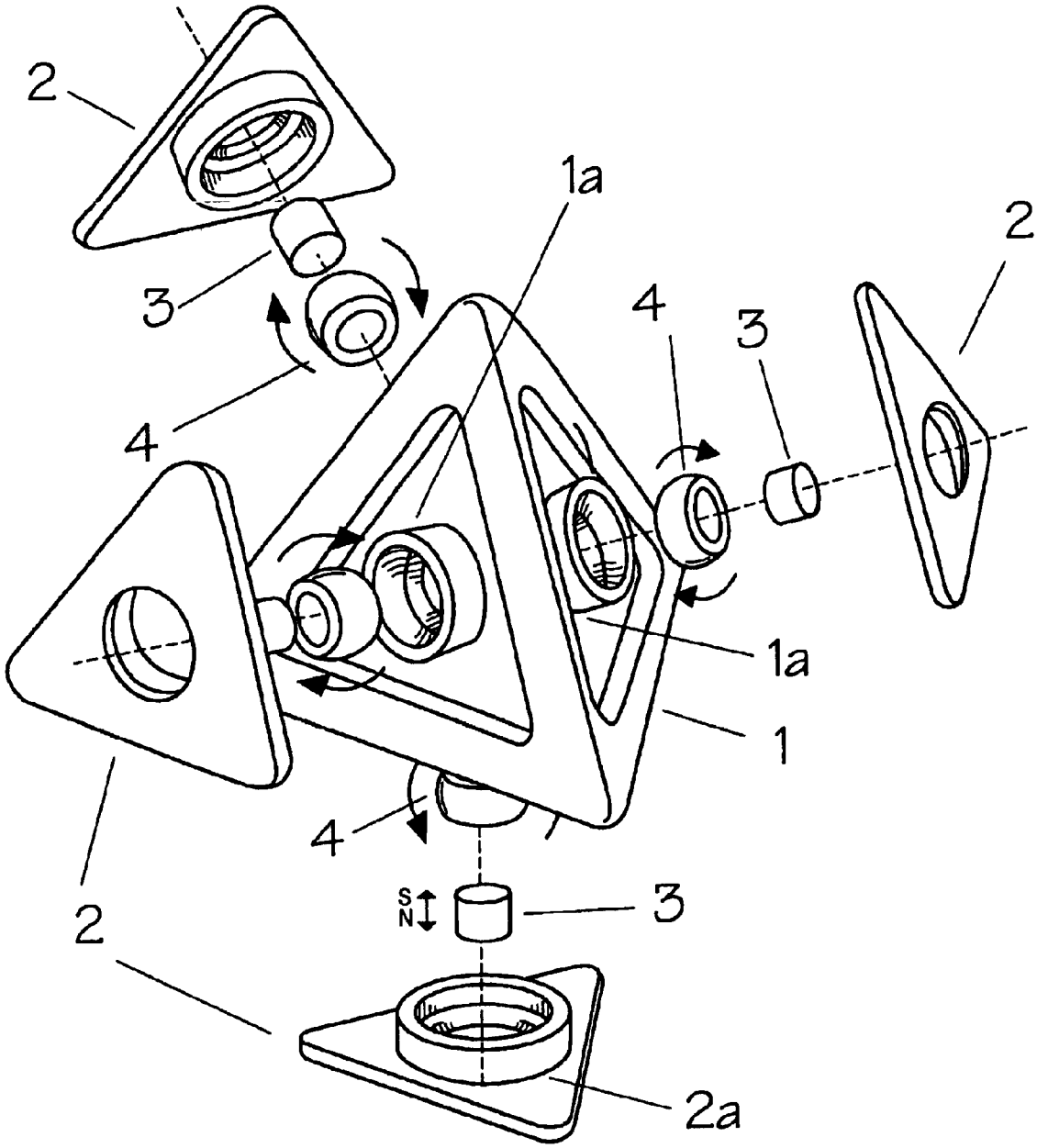
FIG. 1 is a exploded perspective view of a four sided pyramid main body with all components of the devise according to a first embodiment of the present invention.

The preferred embodiments will now be described. FIG. 1 the four sided pyramid main body according to the first embodiment of the present invention. Referring to the designated at 1 is a main body made of injection molded plastic resin. Designated at 1*a* and 2*a* sub bodies having equal spherical segments. Designated at 2 is a injection molded plastic resin retaining cap. Designated at 3 is a disc shaped permanent magnet with axial orientation of its poles. Designated at 4 is a bearing made of injection molded plastic resin. The disc magnet 3 is affixed to the inside diameter of bearing 4. Magnet 3 and bearing 4 combinations are seated between the cavities of the sub bodies 1*a* and 2*a*. Magnet 3, bearing 4 and sub-bodies 1*a* and 2*a* are adhered to the main body 1.

Figure 2:
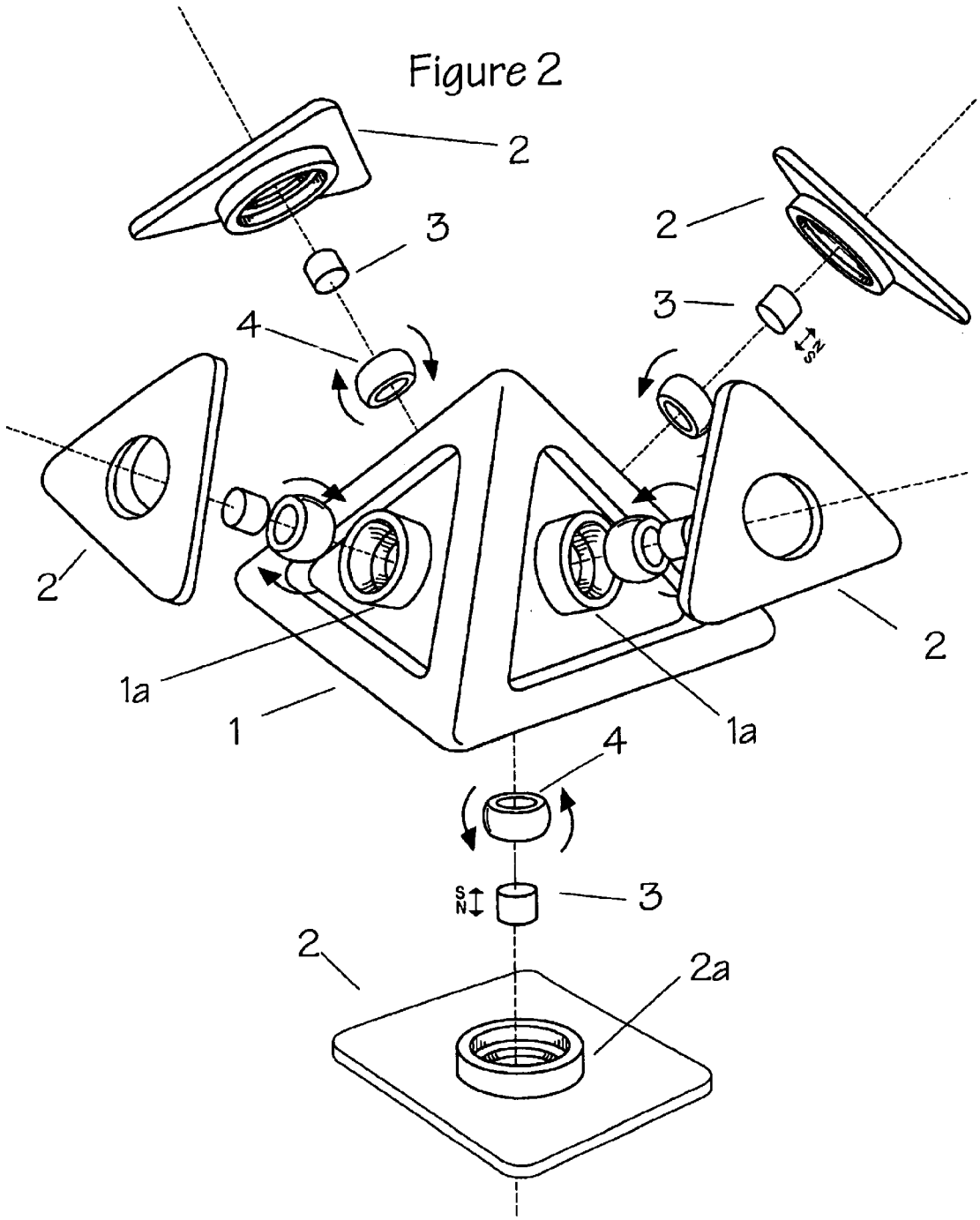
FIG. 2 is a exploded perspective view of a five sided pyramid main body with all components of the devise according to a first embodiment of the present invention.

FIG. 2 the five sided pyramid main body according to the second embodiment of the present invention. Referring to the designated at 1 is a main body made of injection molded plastic resin. Designated at 1*a* and 2*a* are sub bodies having equal spherical segments within there inside diameter. Designated at 2 is a injection molded plastic resin retaining cap. Designated at 3 is a disc shaped permanent magnet with axial orientation of its poles. Designated at 4 is a bearing made of injection molded plastic resin. The disc magnet 3 is affixed to the inside diameter of bearing 4. Magnet 3 and bearing 4 combinations are seated between the cavities of the sub bodies 1*a* and 2*a*. Magnet 3, bearing 4 and sub-bodies 1*a* and 2*a* are adhered to the main body 1.

Figure 3:
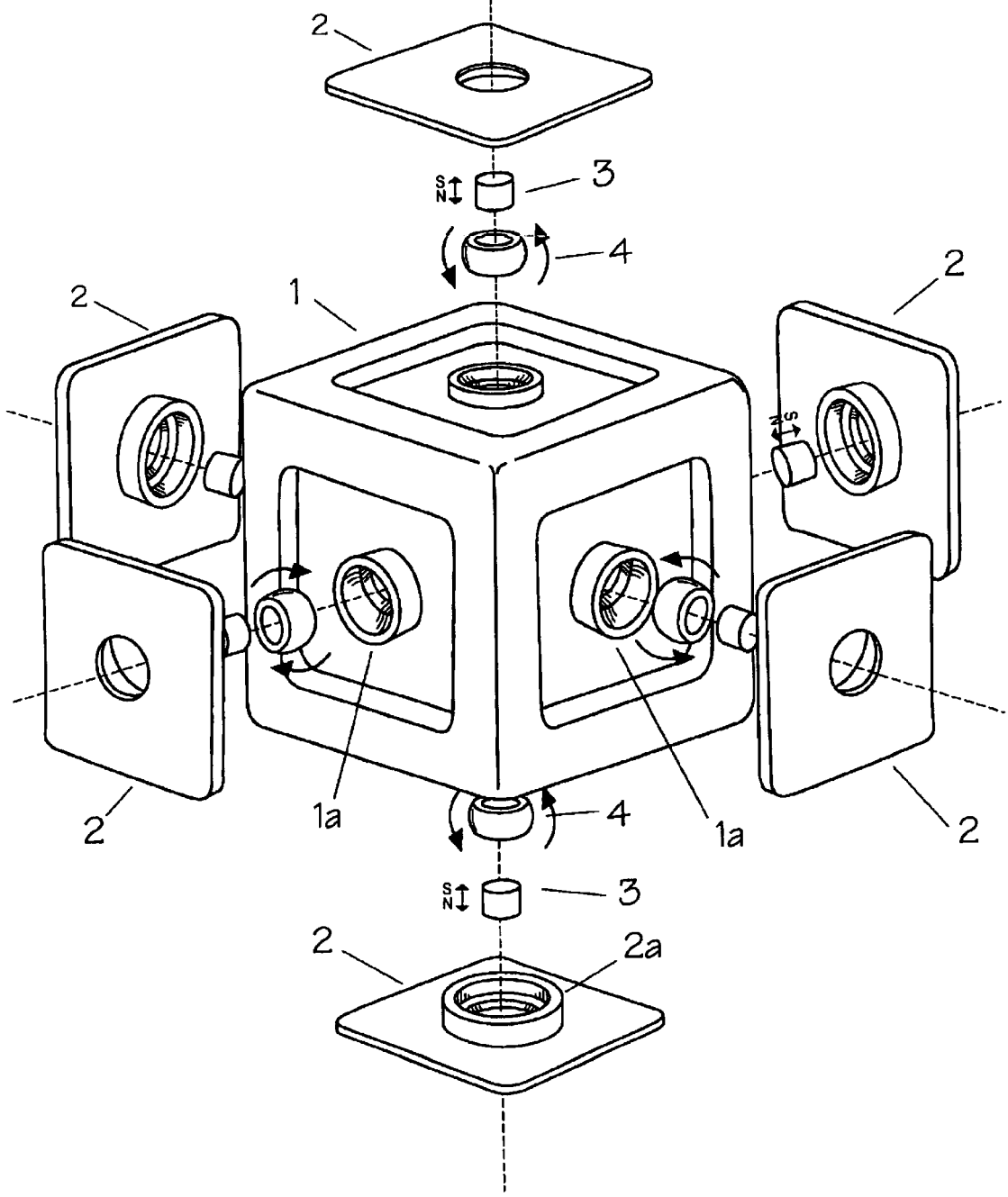
FIG. 3 is a exploded perspective view of a six sided cube main body with all components of the devise according to a first embodiment of the present invention.

FIG. 3 the six sided cube main body according to the third embodiment of the present invention. Referring to the designated at 1 is a main body made of injection molded plastic resin. Designated at 1*a* and 2*a* sub bodies having equal spherical segments. Designated at 2 is a injection molded plastic resin retaining cap. Designated at 3 is a disc shaped permanent magnet with axial orientation of its poles. Designated at 4 is a bearing made of injection molded plastic resin. The disc magnet 3 is affixed to the inside diameter of bearing 4. Magnet 3 and bearing 4 combinations are seated between the cavities of the sub bodies 1*a* and 2*a*. Magnet 3, bearing 4 and sub-bodies 1*a* and 2*a* are adhered to the main body 1.

Figure 4:
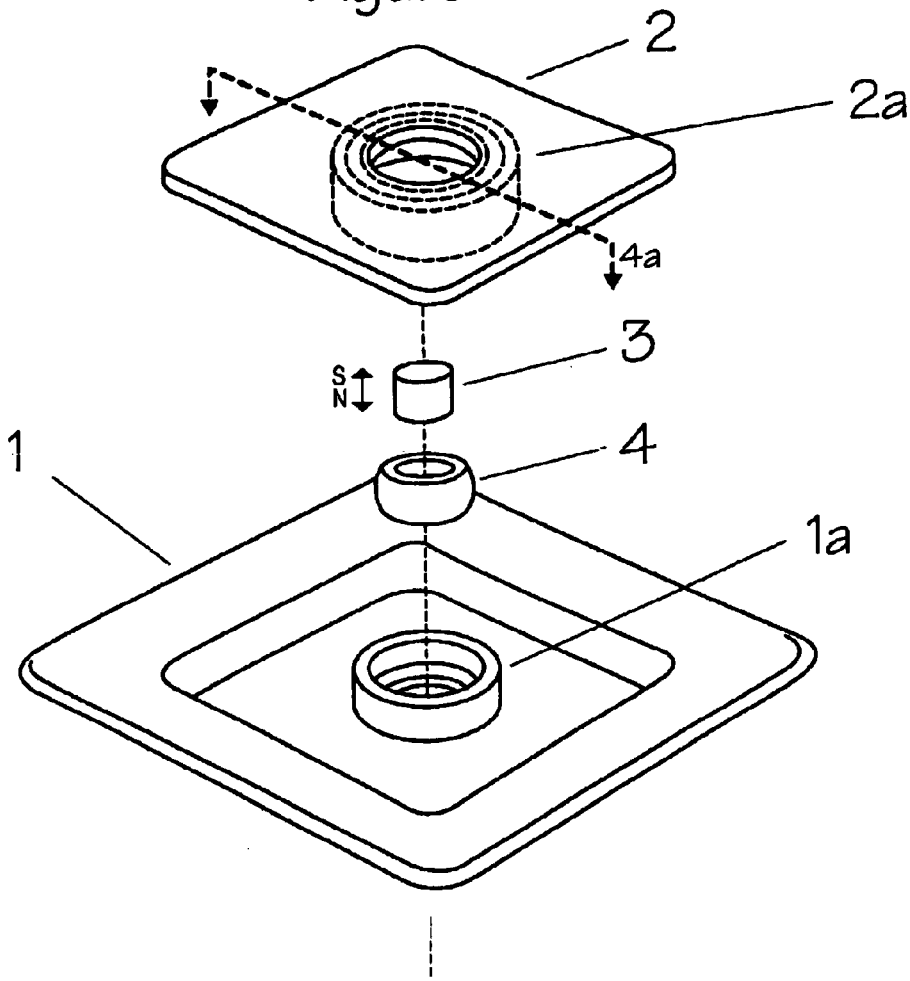
FIG. 4 is a perspective view of a surface from the six sided cube main body with all components of the devise according to a first-embodiment of the present invention.
Figure 4A:
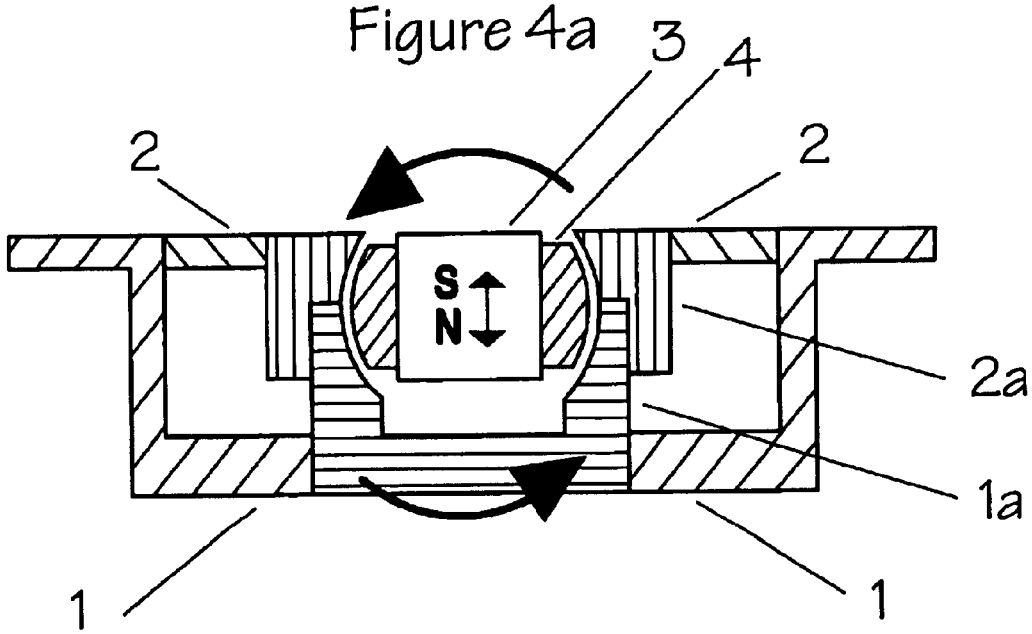
FIG. 4*a* is a cross-sectional view of a surface from the six sided main cube body with all components of the devise according to a first embodiment of the present invention.
Figure 5:
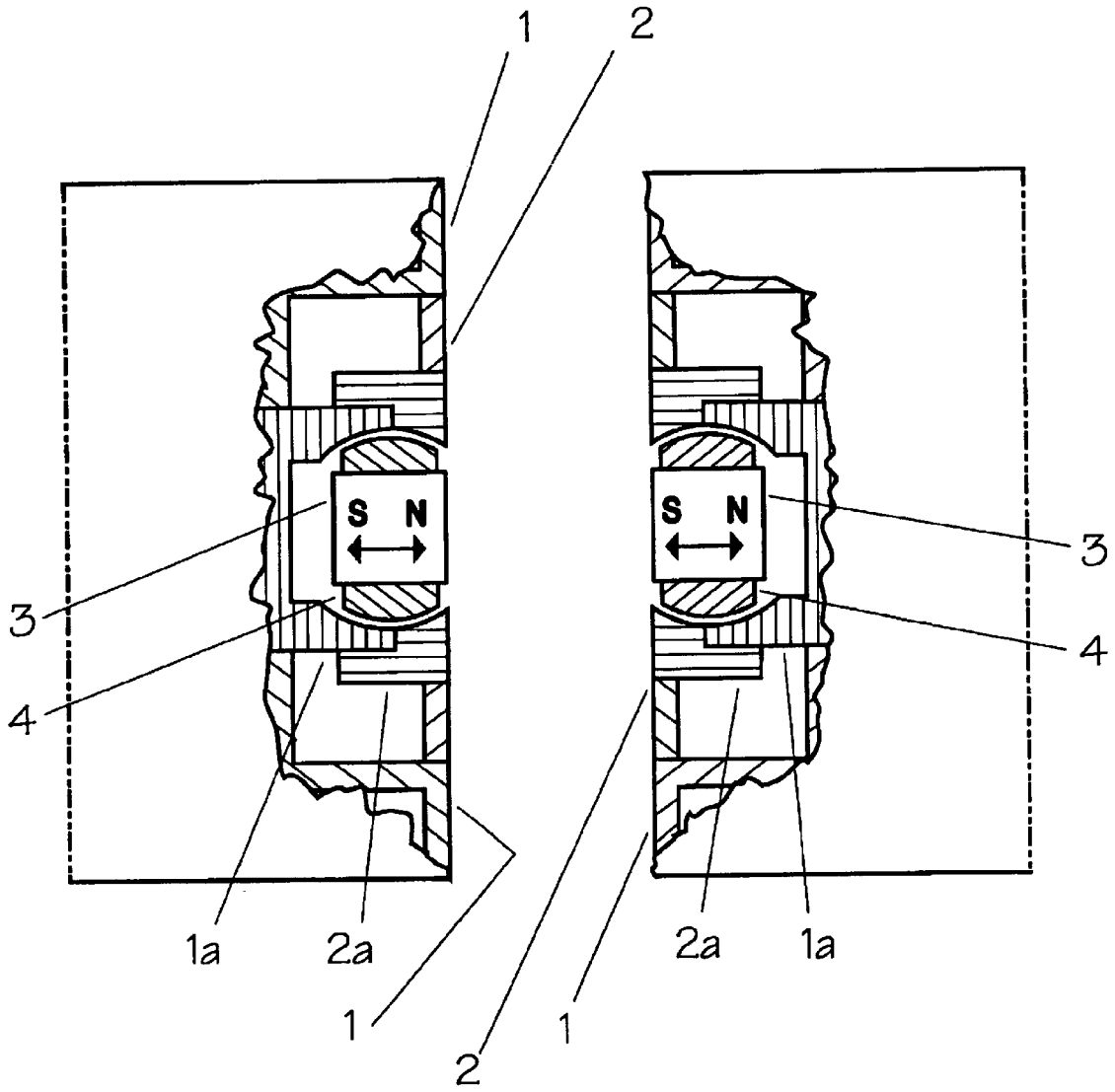
FIG. 5 is a fragmentary cross-sectional view of a surface from the six sided cube main body with all components of the devise according to a first embodiment of the present invention.

FIG. 4*a* is cross section of a surface from the six sided cube main body according to the third embodiment of the present invention. FIG. 5 is a fragmented cross-sectional view of two six sided cube main bodies according to the third embodiment of the present invention. When plural bodies are brought close enough together as to overlap the magnetic flux field of the magnets contained within their bodies the reaction of magnet 3 and bearing 4 will be to rotate to there position of mutual attraction as shown in FIG. 5.

From the forgoing description one can now see how multi-shaped plural bodies are connected utilizing magnets contained within their bodies without the need of matching individual polarities. The attracting bodies can now be used to create a multitude of geometric shapes. Further it has been shown how this invention has improved upon previous inventions through the device which allows a magnet to magnet connection exploiting the maximum strength of magnet 3 and the bearing 4 surface configuration which minimizes rotation resistance.

What is claimed is:

1. A magnetic connector apparatus for releasably securing separate, connector-mounting body members together in abutting condition, the magnetic connector apparatus comprising:

a) a plurality of separate, individual body members, each said body member having a selected plurality of peripheral sides forming a selected, overall body member shape and defining therebetween a body interior, b) at least one magnet-receiving first sub-body member mounted in each said body interior, each said at least one sub-body member being disposed adjacent a different, selected peripheral side of the body member, the first sub-body members each configured as a spherical cavity segment forming a bearing socket cavity having a bearing surface formed as a concave segment of a sphere, c) a rotatable, magnet-mounting bearing member supported in the bearing socket cavity of each said first sub-body member, each bearing member having an outer peripheral edge surface configured as a convex segment of a sphere arranged for support by the concave surface of the bearing socket cavity for substantially free, universal rotation of the bearing member about all diametric axes extending through the center of the bearing member, the bearing member fixedly mounting a magnet in position extending diametrically through the bearing member for disposition of the opposite magnetic poles of the magnet at diametrically opposite points of the peripheral surface of the bearing member, and d) a second sub-body member associated with each said first sub-body member and configured as a bearing socket cavity having a bearing surface formed as a concave segment of a sphere, to retain the magnet-mounting bearing member in freely rotating condition within the first sub-body member captured against inadvertent separation therefrom, whereby e) when the magnets associated with a selected peripheral side of each of two separate body members come into close proximity with one another as the selected sides are moved into confronting position, mutual magnetic attraction rotates each magnet-mounting bearing member on any axis of universal rotation required to orient the respective opposing magnet poles for continuous maximum attraction toward each other as the body members are moved together and into abutting, magnetically connected condition.

2. The magnetic connector apparatus of claim 1 wherein a plurality of first sub-body members are mounted in the interior of a body member for disposition of a sub-body member adjacent each peripheral side of the body member.

* * * * *